United States Patent [19]

Manz

[11] 4,197,965

[45] Apr. 15, 1980

[54] TOOTHPICK DISPENSER

[76] Inventor: Curtis T. Manz, 534½ E. 14th St., Long Beach, Calif. 90801

[21] Appl. No.: 922,768

[22] Filed: Jul. 7, 1978

[51] Int. Cl.[2] ..... B65D 85/20

[52] U.S. Cl. ..... 221/266; 221/288; 221/312 R

[58] Field of Search ..... 221/186, 263, 266, 288, 221/312 R, 312 C

[56] References Cited

U.S. PATENT DOCUMENTS

| | | | |
|---|---|---|---|
| 696,785 | 4/1902 | Yarini | 221/312 R |
| 1,216,907 | 2/1917 | Worden | 221/312 R X |
| 1,396,545 | 11/1921 | Young | 221/288 |
| 2,193,732 | 3/1940 | Luber | 221/312 R X |
| 2,264,554 | 12/1941 | Roemmele | 221/288 |
| 2,448,099 | 8/1948 | Kassovic | 221/312 R |

*Primary Examiner*—Joseph J. Rolla
*Attorney, Agent, or Firm*—William C. Babcock

[57] ABSTRACT

A lightweight, portable, compact, elongate dispenser capable of holding a number of toothpicks in a confined space in a clean and sanitary condition, with the dispenser when it is slowly rotated on its longitudinal axis causing one of the toothpicks to be engaged in a dispensable position, and by a further manual operation the engaged toothpick being dispensed without physically touching the balance of the toothpicks.

3 Claims, 9 Drawing Figures

FIG. 1
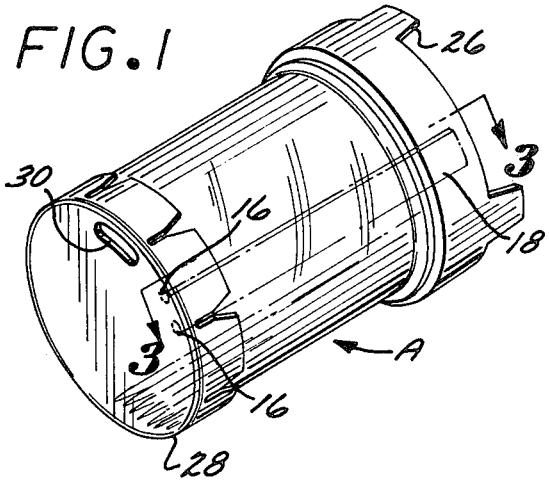
FIG. 2
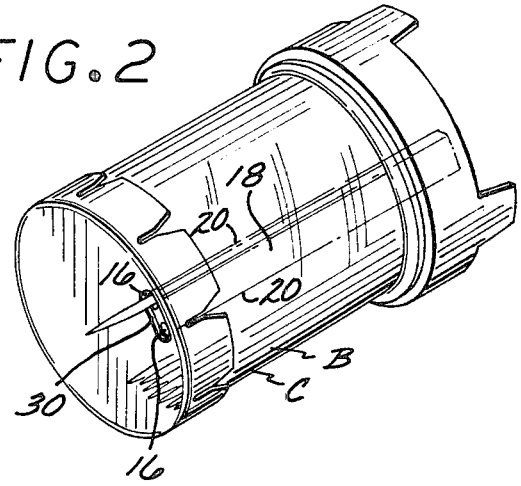
FIG. 3
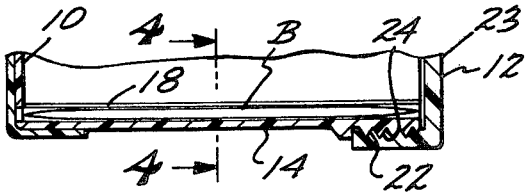
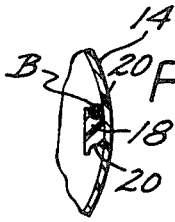
FIG. 4
FIG. 5
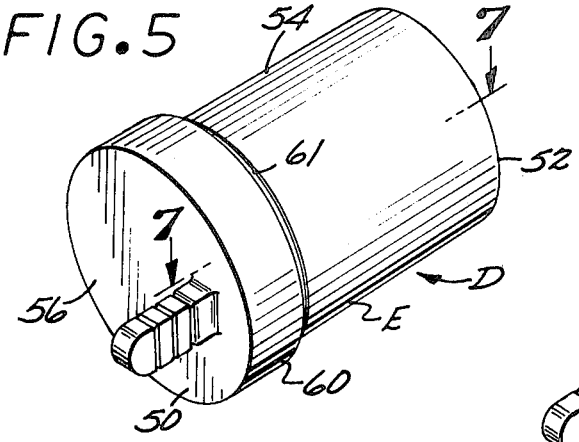
FIG. 6
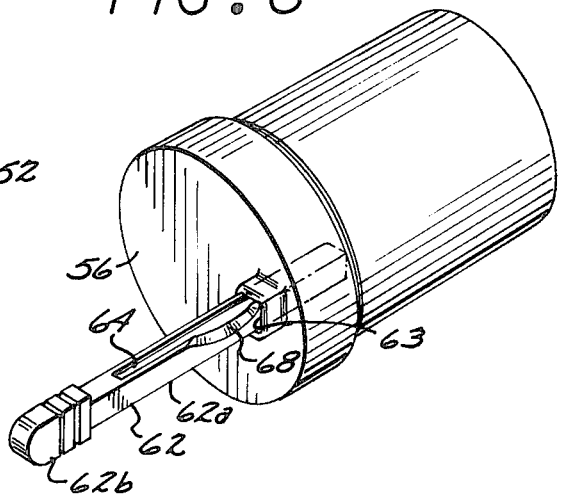
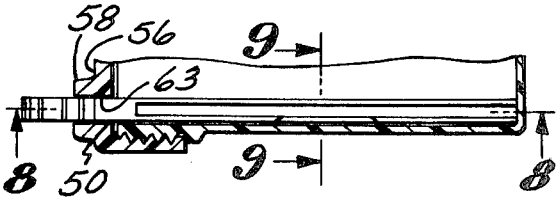
FIG. 7
FIG. 9
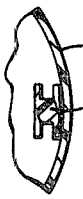
FIG. 8
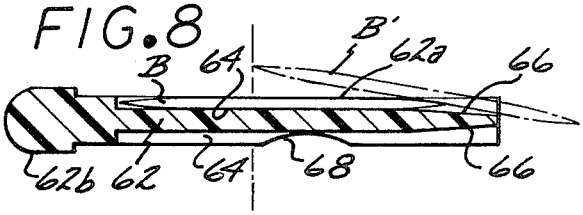

TOOTHPICK DISPENSER

BACKGROUND OF THE INVENTION

1. Field of the Invention

Toothpick Dispenser.

2. Description of the Prior Art

In the past, numerous toothpick dispensers have been devised and used, but these prior art devices have suffered from the operational disadvantages that they were of a complicated mechanical nature, bulky, and were not readily movable from place to place as required. In addition, due to the complexity of their structure, they were expensive and their use was accordingly limited.

A major object of the present invention is to provide a compact, lightweight, portable toothpick dispenser that has an extremely simple mechanical structure, can be fabricated from standard commercially available materials, and sold at a sufficiently low price as to encourage the widespread use thereof.

Another object of the invention is to provide a toothpick dispenser that maintains the toothpicks in a clean and sanitary condition prior to the toothpicks being dispensed one by one.

Yet another object of the invention is to supply a toothpick dispenser that is readily adaptable to being formed from plastic material by conventional molding or forming operations.

SUMMARY OF THE INVENTION

The invention is a light weight portable toothpick dispenser that maintains the toothpicks in a clean and sanitary condition while the toothpicks are stored, and from which dispenser the toothpicks may be removed sequentially one by one as required by a simple manual operation. The dispenser includes an elongate container that has first and second closed ends and a continuous side wall that cooperates with the first and second ends to define a confined space in which a number of the toothpicks are disposed side by side. An elongate member is provided that is longitudinally disposed in the confined space and adjacent to the side wall previously described, with the member having a first side surface in which a longitudinally extending groove is formed that removably engages and supports one of the toothpicks when the container is held in the substantially horizontal position, and the container thereafter slowly rotated on the longitudinal axis thereof until the groove is engaged by one of the toothpicks. By a simple manual operation the engaged toothpick is caused to move longitudinally through an opening in a first end of the container, as the user of the invention desires to dispense the toothpick. The elongate member as will later be explained in detail, may be either stationary relative to the container, or movable relative thereto.

BRIEF DESCRIPTION OF THE DRAWING

FIg. 1 is a perspective view of the first form of the invention in a non-dispensing position;

FIG. 2 is the same perspective view as shown in FIG. 1, but with the invention being disposed in a dispensing position;

FIG. 3 is a longitudinal cross-sectional view of the invention taken on the line 3—3 of FIG. 1;

FIG. 4 is a fragmentary transverse cross-sectional view of the first form of toothpick dispenser taken on the line 4—4 of FIG. 3;

FIG. 5 is a perspective view of a second form of toothpick dispenser in a non-toothpick dispensing position;

FIG. 6 is the same perspective view as shown in FIG. 4 but with the invention being disposed to dispense the single toothpick therefrom;

FIG. 7 is a longitudinal cross-sectional view of the second form of the invention taken on the line 7—7 of FIG. 5;

FIG. 8 is a longitudinal cross-sectional view of a second form of the invention illustrating the elongate movable member used therewith, and illustrating the manner in which a second toothpick is rejected when a first toothpick is being withdrawn from the second form of the invention; and FIG. 9 is a fragmentary transverse cross-sectional view of the elongate movable member taken on the line 9—9 of FIG. 7.

DESCRIPTION OF THE PREFERRED EMBODIMENT

A first form of the toothpick dispenser A is illustrated in perspective in FIGS. 1 and 2, in which it will be seen that a number of toothpicks B are stored side by side in longitudinal relationship within a container C. The container C in the drawings is illustrated as including a first circular end 10, a second end 12, and a cylindrical side wall 14 that extends between the first and second ends 10 and 12. The first end 10 as may be seen in FIG. 1, has two spaced openings 16 adjacent the outer periphery thereof. An elongate member 18 is provided that is bonded or otherwise secured to the interior surface of the side wall 16, with the elongate member having two longitudinally extending oppositely disposed grooves 20 formed therein that are aligned with the two spaced openings 15. The second end 10 is illustrated in FIGS. 1, 2 and 3 as including a circular web 23 that has an internally threaded circular rib 22 projecting therefrom that removably engages external threads 24 formed on the cylindrical side wall 14. The second end 12 preferably includes a number of circumferentially spaced, outwardly extending legs 26 that permit the first form of dispenser A to rest in an upright position on a horizontal surface (not shown). The first form A of the invention includes a cup-shaped cover 28 that frictionally grips the exterior surface of the side wall 14 but may be rotated relative to the side wall. The cover 28 has an arcuate slot 30 formed therein that may be aligned with the two openings 16. Although two openings 16 are shown in the drawings, as well as two grooves 20, the invention will operate satisfactorily by a single groove 20 and a single opening 16 is provided.

In use, the first form A of the invention is first filled with toothpicks, and the invention when it is desired to dispense a toothpick is slowly rotated on its longitudinal axis, to allow a toothpick B to engage one of the grooves 20. The cover 28 is now rotated to align the slot 30 with the groove 16, and the first form A of the invention is turned to dispose the first end 10 in a downward position. By gravity, the engaged toothpick B slides from the groove 20 in which it is disposed through the associated opening 16 and slot 30 to be dispensed from the first form A of the invention. The cover 28 is now rotated to the position shown in FIG. 1, and the dispenser A is returned to an upright position for the legs 26 to rest on a horizontal surface are now shown. the first form A of the dispenser will so remain until it is desired to dispense another toothpick therefrom whereupon the above described operation is repeated.

The second form D of the invention can best be seen in FIGS. 5 to 8 inclusive includes a container E in which a number of the toothpicks B may be disposed in longitudinal relationship side by side. The container E includes a first end 50, a second end 52, and a cylindrical side wall 54 that extends therebetween. The first end 50 is illustrated as including a transverse web 56 that has a heavied wall portion formed as a part thereof, and the web having a circular side wall of relatively shallow depth extending therefrom that has threads on the interior surface thereof that removably engage threads 61 formed on an end portion of the side wall 54. An elongate member 62 is provided that is of non-circular transverse cross-section and is slidably disposed in an opening 63 formed in the heavied wall portion 58. Elongate member 62 includes an elongate portion 62*a* that is disposed within the confines of the container E when the second form of the invention is in a non-toothpick dispensing position as illustrated in FIG. 5. Elongate member 62 also includes a second outwardly disposed section 62*b* of greater transverse cross-section than the opening 63, with the second section being outwardly disposed from the web 56 and serving as a handle to manually engage elongate member 62. The first section 62*a* of elongate member 62 is illustrated as having two oppositely disposed longitudinally extending grooves 64 formed therein, either of which grooves may engage one of the toothpicks B.

When it is desired to dispense the toothpicks B the second form of the invention D is rotated slowly on its longitudinal axis to dispose a toothpick in one of the grooves 64 with the elongate member 62 then being withdrawn from the center to permit the toothpick B to be lifted from the engaged groove.

The grooves 64 on the ends thereof opposite that adjacent the section 62*b* taper inwardly towards one another as indicated by the numeral 68 in FIG. 8. In the event a second tooth pick B′ rests on a toothpick B supported in one of the grooves 64, the second toothpick B′ will assume the angled position shown in phantom line in FIG. 8 due to the tapered groove portion 66 as the elongate member 62 is withdrawn from the container D. Due to this angled position, the second toothpick B′ will have the forward end thereof contact the interior surface of web 56, and will not be moved outwardly through opening 63 with the first toothpick B. The member 62 has oppositely disposed recesses 68 therein that communicate with grooves 64 to permit a dispensed toothpick B to be grasped between the users thumb and forefinger and removed from the supporting groove 64.

The use and operation of the invention has been described previously in detail and need not be repeated.

What is claimed is:

1. A light weight portable toothpick dispenser that maintains the toothpicks in a clean and sanitary condition, and from which dispenser the toothpicks may be removed one by one as required, which dispenser includes:

a. an elongate container having first and second closed ends and a continuous side wall that cooperates with said first and second ends to define a confined spaced in which a plurality of toothpicks may be disposed, with the interior surfaces of said first and second ends being longitudinally spaced a distance slightly greater than the length of said toothpicks;

b. an elongate member longitudinally disposed in said confined space and disposed adjacent to said side wall, said member having a first side surface in which a longitudinally extending groove is formed that removably engages and supports one of said toothpicks when said container is held in a substantially horizontal position and slowly rotated on the longitudinal axis thereof until said engagement is effected; and c. said elongate member being slidably mounted for longitudinal movement in an opening in said first end, said member being of substantially greater length than the length of said confined space, said member including first and second longitudinal sections, said first section being disposed in said confined space and said second section disposed exteriorly of said first end when said member is in a first position, said first section having said longitudinal groove therein with a toothpick being dispensed when said first section of said member and said toothpick supported in said groove are concurrently moved outwardly through said open end to a position exterior of said container, said groove adjacent a free end of said first section of said member tapering inwardly to prevent a second one of said toothpicks that rests on said toothpick in said groove being withdrawn through said opening.

2. A toothpick dispenser as defined in claim 1 in which said member and opening are of non-circular transverse cross-section to prevent said member rotating relative to said container.

3. A toothpick dispenser as defined in claim 1 in which said second section is of greater transverse cross-section than said opening to prevent said second section being inadvertently inserted through said opening into said confined space.

* * * * *